United States Patent [19]

Aragona

[11] Patent Number: 4,643,106

[45] Date of Patent: Feb. 17, 1987

[54] SAFETY LOCK DEVICE

[76] Inventor: Joel Aragona, 328 W. 89th St., New York, N.Y. 10024

[21] Appl. No.: 660,148

[22] Filed: Oct. 12, 1984

[51] Int. Cl.[4] ..... E05G 3/00; E05B 47/00

[52] U.S. Cl. ..... 109/6; 70/267; 292/144; 109/59 T

[58] Field of Search ..... 109/6–8, 109/63, 59 T, 68; 292/92, 144, 201, 182; 70/267, DIG. 45, DIG. 48, DIG. 50; 49/68

[56] References Cited

U.S. PATENT DOCUMENTS

| | | | |
|---|---|---|---|
| 215,777 | 5/1879 | Shaw | 70/DIG. 50 |
| 1,178,697 | 4/1916 | Yurow | 292/182 |
| 1,965,005 | 7/1934 | Schlachter | 292/144 |
| 2,079,824 | 5/1937 | Smeaton et al. | 109/7 |
| 2,146,134 | 2/1939 | Zuber | 70/267 |
| 3,100,389 | 8/1963 | Noregaard | 109/68 |

*Primary Examiner*—Gary L. Smith
*Assistant Examiner*—Neill Wilson
*Attorney, Agent, or Firm*—Marvin Feldman

[57] ABSTRACT

A manually actuable lock is disposed on the inside of an outside door leading to a vestibule. The lock, when manually actuated from inside the vestibule only, throws a dead bolt for a pre-determined period of time so as to secure the user in the vestibule from parties outside the vestibule. During the predetermined period, the user then gains access to the building through a key actuated lock on the inner door of the vestibule. A piston and cylinder retarding element provides for the timed retraction of the dead bolt.

9 Claims, 5 Drawing Figures

SAFETY LOCK DEVICE

FIELD OF THE INVENTION

This invention relates to safety locks. More specifically, this invention relates to a lock construction and combination for providing a vestibule which is secured from unwanted intruders.

BACKGROUND AND DISCUSSION OF THE PRIOR ART

In certain types of devices it was known to provide timed, actuated locking mechanisms using electrical or clock mechanisms. Such devices are disclosed in U.S. Pat. No. 3,800,522, granted Apr. 2, 1974 to Beharelle; U.S. Pat. No. 2,210,186, granted Aug. 6, 1940 to Ross; and U.S. Pat. No. 2,145,314, granted Jan. 31, 1939 to Murtagh.

Heretofore it was known to provide elaborate electronic systems for limiting access to a lobby. Systems of this nature are disclosed in U.S. Pat. No. 3,484,561, granted Dec. 16, 1969 to Matthews.

A security problem exists today, however, for people entering the vestibule of a building who are accosted or mugged by intruders because such people are unable to open the lobby door rapidly. Very often muggers follow the tenants to the building and wait while the tenant fumbles for the key to the lobby door.

The aforesaid prior art does not suitably address this problem.

Now there is provided by the present invention a safety lock construction and combination which provide the tenant with the ability to readily lock out unwanted intruders from the building vestibule for a predetermined period of time, while the tenant gains access to the lobby of the building, thus foiling any mugging attempts by the intruder.

BRIEF SUMMARY OF THE INVENTION

A safety lock is provided with ready manual action from the inside of the vestibule only, to throw a bolt to lock the outer door for a predetermined period of time, during which period the user enters the lobby by key actuation of the lobby door. After the predetermined period, the bolt retracts to the open position. Thus the user is secured in the vestibule from potential muggers.

DESCRIPTION OF THE PREFERRED EMBODIMENTS

Figure 1:
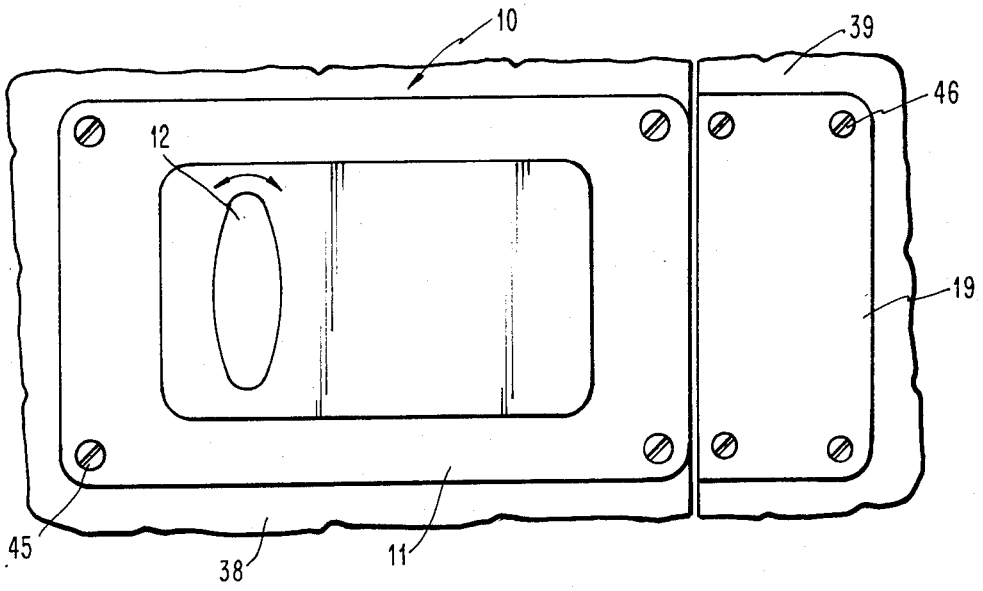
FIG. 1 is a front elevational view of the lock of the present invention.
Figure 5:
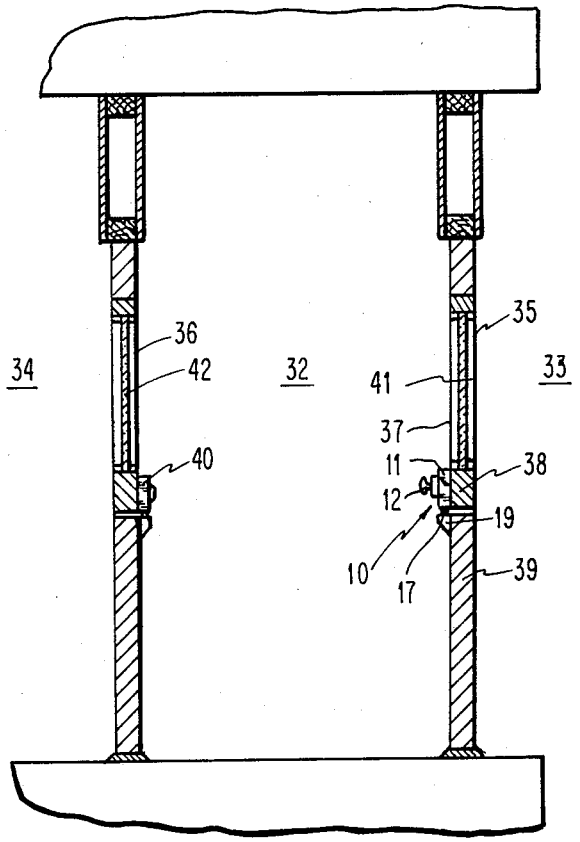
FIG. 5 is a plan, partial schematic view of the lock invention disposed in actual use for vestibule safety.
Figure 2:
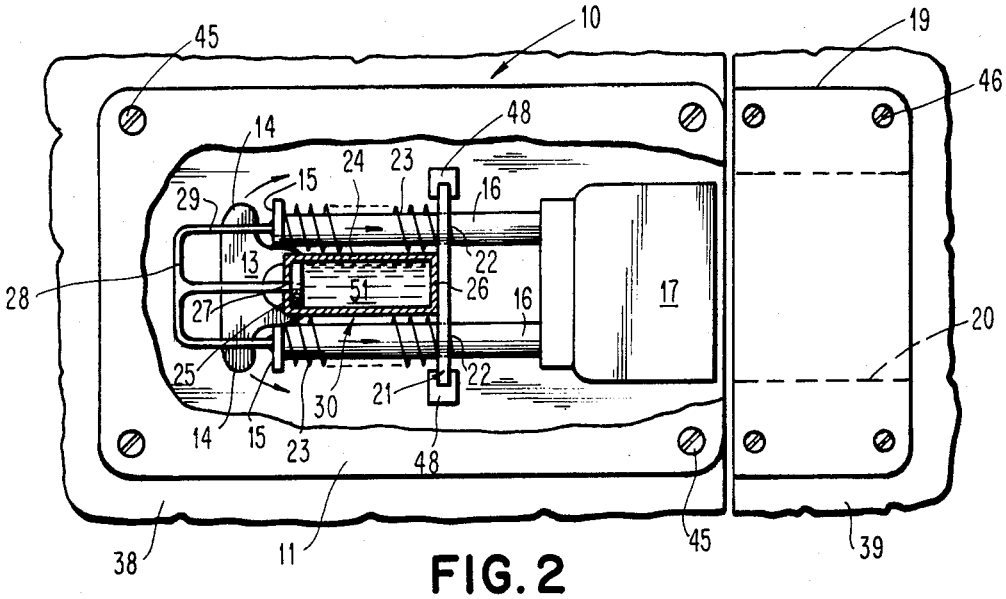
FIG. 2 is a rear partial schematic view of the lock of FIG. 1 in the open position.
Figure 3:
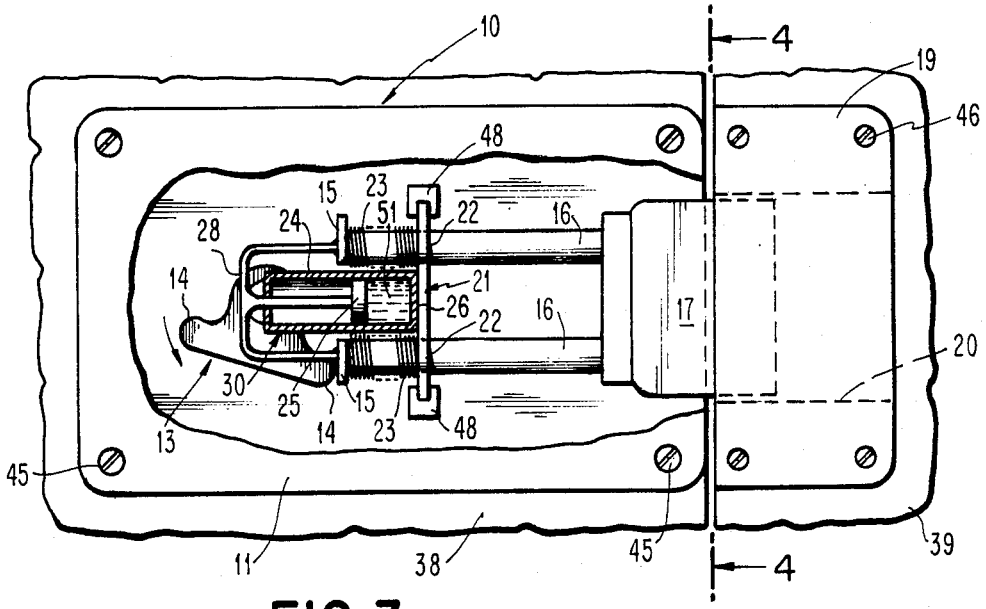
FIG. 3 is the lock as shown in FIG. 2 but in the closed position.
Figure 4:
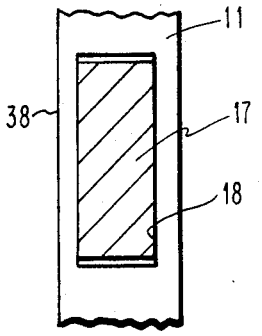
FIG. 4 is a partial sectional view taken along line 4—4 of FIG. 3.

Referring to FIGS. 1–4, there is shown the safety lock of the present invention generally designated as 10. Lock 10 in broad terms is formed of housing 11 which is provided with knob 12 for rotatably actuating rotatable cam element 13 having opposed cam surfaces 14 for contactingly engaging opposed plates 15. Plates 15 are integrally mounted to cylindrical posts 16 which in turn are fixedly mounted to dead bolt 17. Dead bolt 17 is slidably retractably extendibly mounted in housing 11 as at 18. Housing 11 is formed with mounting holes 45 (typical) for mounting to the frame of an outer door (FIG. 5). A second housing 19 is mounted to the building frame through mounting holes 46 and adjacent to housing 11 (FIG. 5). Housing 19 is provided with a rectangular recess 20 for receiving extended bolt 17 (FIG. 3). Mounting holes 46 (typical) are provided for mounting housing 19 to a frame.

A cross-member 21 is formed with spaced through holes 22 for mounting on posts 16. A pair of compression springs 23 are mounted on respective posts 16 between plates 15 and cross-member 21. Dash pot 30 is formed with a cylinder 24 and piston 25 which cylinder is fixedly mounted to the central portion 26 of cross-member 21. End 27 of piston 25 is connected to yoke 28 which is formed with ends 29 which are bonded to plates 15. Cross-member 21 is fixedly mounted to housing 10 as at 48.

Referring now to FIG. 5, there is shown vestibule area 32, outside or street area 33 and lobby area 34. Outside door 35 is mounted so as to separate outside area 33 from vestibule area 32, while inside or lobby door 36 separates vestibule area 32 from lobby area 34. Lock 10 is disposed on the inside 37 of door 35, so that access to knob 12 is only achievable from the inside of the vestibule. Housing 11 is mounted to door frame 38 of door 35, while adjacent housing 19 is mounted to the wall frame portion 39. Knob 12 is shown in the crosswise or closed position so that bolt 17 is engaged in recess 20 of housing 19. A conventional key actuable lock 40 is mounted on lobby door 36, for access to the lobby by a user with the necessary key. Doors 35 and 36 may comprise glass portions 41 and 42, respectively. The user in vestibule 32 can see a potential mugger through glass 41 and actuate lock 10.

By the aforesaid manner of construction, the user enters vestibule 32 through door 35. Upon seeing a possible assailant or mugger, the user turns knob 12 of lock 10 from a vertical to a horizontal position by either clockwise or counterclockwise rotation, to cause the rotation of cam element 13 so that one of the two cam bearing surfaces 14 contacts plates 15 causing the extension of bolt 17, and concomitantly the compression of springs 23. At the same time piston 25 is advanced through cylinder 24 of dash pot 30. Springs 23 are biased to cause the return or retraction of bolt 17. However, the dash pot and its fluid 51 are sized to prevent the immediate retraction of the bolt, but instead cause slow retraction over a pre-determined period of about 20–80 seconds. During this period, the user is secured in the vestibule, and has sufficient time to locate the key and unlock the lobby door 36.

If the user requires more time in which to unlock the lobby door, the user merely returns the knob to the horizontal position, to obtain another full 20–80 second period.

It is important to note that whether the user turns the knob clockwise or counterclockwise, the bolt is fully extended. This is important in that under the exigent circumstances surrounding securing the outside door, the user need not be concerned that he or she is turning in the right direction, insofar as turning in either direction extends the dead bolt.

While the spring return retarding element is described as a dash pot, other equivalent elements are contemplated, including air cylinders, and the like. Battery or line current elements are contemplated but are highly undesirable in the present application in that loss of power, or short-circuiting would render the lock useless. Therefore the fully mechanical piston and cylinder with the slow fluid bleed is most desirable.

There has been shown to be a highly effective, manually actuable, fixed safety lock for vestibule safety to foil intruders or muggers.

Since various modifications can be made in the above invention, and many apparently widely different embodiments of same, made within the scope of the claims without departing from the spirit and scope thereof, it is intended that all matter contained in the accompanying specification shall be interpreted as illustrative only and not in a limiting sense and I desire only such limitations placed thereon as are specifically expressed in the accompanying claims.

What is claimed is:

1. In combination, a first door, said first door being formed with a key actuable lock, and a second door, said second door being oppositely disposed from said first door so as to form a vestibule, said second door being formed with a safety lock comprising; a first housing; a laterally displaceable bolt operatively disposed in said first housing; a second housing, said second housing being juxtaposed with said first housing, so that said bolt may be at least partially displaced from within said first housing and extended into said second housing by manipulation; a rotatable knob means, said knob means being operatively connected to said bolt for temporarily extending said bolt from said first housing and towards said second housing; the operative connection including a cam element, said cam element being attached to said knob means for displacement, and having two opposed ears comprising cam surfaces; two plates, each of said cam surfaces alternately cooperating with and displacing one of said plates; two movable cylindrical posts, each of said plates being mounted to one end of one of said movable cylindrical posts, said posts being in registration and parallel to each other with the other end of each of said posts extending to attachment to said bolt, so that alternate displacement of one of said posts, serves to at least partially displace said bolt; a transverse cross member perpendicular to said posts, said cross member being fixedly mounted to said first housing and having two opposed circular openings to guide the rectilinear movement of said posts; two helical compression springs, each of said springs being mounted to one of said cylindrical posts and extending between said cross member and one of said plates; a yoke, said yoke having a bifuraction comprising two opposed lateral arms, each of said arms extending to an attachment to one of said plates, said arms straddling a middle leg portion of said yoke; a dash pot, said leg portion extending to the piston portion of said dash pot, said dash pot including an enclosed cylindrical member containing a fluid, so that a slow fluid bleed is attained when said piston is displaced, and the base of said cylinder opposite to said yoke being fixedly and centrally attached and mounted to said cross member; the action of said two helical compression springs being capable of being alternately retarded by said yoke and said dash pot, so that said remains extended for a pre-determined locking period and then is retracted for self-unlocking.

2. The combination of claim 1, said key lock being disposed so as to be actuable by said key from the vestibule, and said safety lock being disposed so that said knob means is actuable only from said vestibule, whereby a user first actuates said safety lock to be secured in the vestibule for said period, and in which said period, the user opens the first door.

3. The combination of claim 1, said knob being turnable in the reverse direction, and wherein the bolt is retractably extended in each direction.

4. The combination of claim 1, in which the bolt of the safety lock is a dead bolt.

5. The combination of claim 1, in which the first housing of the safety lock is mounted to the second door, and the second housing of the safety lock is mounted to a fixed member.

6. The combination of claim 5, in which the fixed member is a wall frame portion.

7. A safety lock comprising; a first housing; a laterally displaceable bolt operatively disposed in said first housing; a second housing, said second housing being juxtaposed with said first housing, so that said bolt may be at least partially displaced from within said first housing and extended into said second housing by manipulation; a rotatable knob means, said knob means being operatively connected to said bolt for temporarily extending said bolt from said first housing and towards said second housing; the operative connection including a cam element, said cam element being attached to said knob means for displacement, and having two opposed ears comprising cam surfaces; two plates each of said cam surfaces alternately cooperating with and displacing one of said plates; two movable cylindrical posts, each of said plates being mounted to one end of said movable cylindrical post, said posts being inregistration and paralled to each other, with the other end of each of said posts extending to attachment to said bolt, so that alternate displacement of one of said posts serves to at least partially displace said bolt; a transverse cross member perpendicular to said posts, said cross member being fixedly mounted to said first housing and having two opposed circular openings to guide the rectilinear movement of said posts; two helical compression springs, each of said springs being mounted to one of said cylindrical posts and extending between said cross member and one of said plates; a yoke, said yoke having a bifuraction comprising two opposed lateral arms, each of said arms extending to an attachment to one of said plates, said arms straddling a middle leg portion of said yoke; a dash pot, said leg portion extending to the piston portion of said dash pot, said dash pot including an enclosed cylindrical member containing a fluid, so that a slow fluid bleed is attained when said piston is displaced, and the base of said cylinder opposite to said yoke being fixedly and centrally attached and mounted to said cross member; the action of said two helical compression springs being capable of being alternately retarded by said yoke and said dash pot, so that said bolt remains extended for a pre-determined locking period and then is retracted for self-unlocking.

8. The lock of claim 7, said bolt being a dead bolt.

9. The combination of claim 7, said knob being turnable in the reverse direction, and wherein the bolt is retractably extended in each direction.

* * * * *